US012727642B2

(12) United States Patent
Tateno et al.

(10) Patent No.: US 12,727,642 B2
(45) Date of Patent: Sep. 8, 2026

(54) SOLE AND SHOE

(71) Applicant: ASICS CORPORATION, Kobe (JP)

(72) Inventors: Kenta Tateno, Kobe (JP); Hiroaki Nishimura, Kobe (JP); Yasuo Umetani, Kobe (JP); Masanori Sakaguchi, Kobe (JP); Hiromichi Otake, Kobe (JP)

(73) Assignee: ASICS CORPORATION, Kobe (JP)

( * ) Notice: Subject to any disclaimer, the term of this patent is extended or adjusted under 35 U.S.C. 154(b) by 0 days.

(21) Appl. No.: 18/591,300

(22) Filed: Feb. 29, 2024

(65) Prior Publication Data

US 2024/0292926 A1 Sep. 5, 2024

(30) Foreign Application Priority Data

Mar. 3, 2023 (JP) ..... 2023-032622

(51) Int. Cl.
*A43B 13/12* (2006.01)
*A43B 13/18* (2006.01)

(52) U.S. Cl.
CPC ..... *A43B 13/125* (2013.01); *A43B 13/186* (2013.01)

(58) Field of Classification Search
CPC ..... A43B 13/125; A43B 13/14; A43B 13/186; A43B 23/0245; A43B 5/06; A43B 7/1415; A43B 7/1445
See application file for complete search history.

(56) References Cited

U.S. PATENT DOCUMENTS

| | | | | |
|---|---|---|---|---|
| 4,041,619 | A * | 8/1977 | Sapper | A43B 13/145 36/103 |
| 4,335,530 | A * | 6/1982 | Stubblefield | A43B 13/37 36/83 |
| 7,555,848 | B2 | 7/2009 | Aveni et al. | |
| 10,165,825 | B2 | 1/2019 | Langvin et al. | |
| 10,709,198 | B2 | 7/2020 | Ito et al. | |

(Continued)

FOREIGN PATENT DOCUMENTS

| | | | |
|---|---|---|---|
| JP | WO2020136916 | A1 | 7/2020 |
| KR | 100945834 | B1 | 3/2010 |
| KR | 20100011725 | U | 12/2010 |

OTHER PUBLICATIONS

EP Search Report dated Jul. 29, 2024 for Application No. 24160313.3-1015, 11 pp.

*Primary Examiner* — Bao-Thieu L Nguyen
(74) *Attorney, Agent, or Firm* — KONRAD, RAYNES, DAVDA & VICTOR LLP; Alan S. Raynes

(57) ABSTRACT

A sole includes a midsole, and the midsole includes a toe support portion, a midfoot support portion, and an intervening portion. The sole includes a toe contact surface and a midfoot contact surface. The intervening portion has a recessed portion having a shape recessed from an imaginary curved surface toward a side of a wearer's foot. A length between the imaginary curved surface and the recessed portion is greater than or equal to 13% and less than or equal to 50% of a thickness of a portion of the intervening portion where the recessed portion is provided. The midsole has a front side region surrounded by a front line and a rear line, and an area of the recessed portion in plan view is greater than or equal to 35% and less than or equal to 50% of an area of the front side region in plan view.

17 Claims, 6 Drawing Sheets

(56) References Cited

U.S. PATENT DOCUMENTS

| | | | | |
|---|---|---|---|---|
| 2007/0094815 | A1* | 5/2007 | Barak | A43B 7/147 36/40 |
| 2011/0277351 | A1* | 11/2011 | Scoledes | A43B 5/10 264/129 |
| 2011/0296715 | A1* | 12/2011 | Howell | A43B 7/26 36/136 |
| 2012/0240430 | A1* | 9/2012 | Shin | A43B 5/14 36/103 |
| 2012/0246976 | A1* | 10/2012 | Weiler | A43B 13/146 36/25 R |
| 2014/0123522 | A1* | 5/2014 | Rustam | A43B 7/145 36/25 R |
| 2015/0223564 | A1* | 8/2015 | Peyton | A43B 23/0255 36/28 |
| 2016/0037857 | A1* | 2/2016 | Foxen | A43B 7/1485 36/103 |
| 2016/0037858 | A1* | 2/2016 | Foxen | A43B 13/181 36/103 |
| 2018/0368519 | A1* | 12/2018 | Lilley | A43B 13/04 |
| 2019/0082781 | A1* | 3/2019 | Iuchi | A43B 13/026 |
| 2021/0259356 | A1* | 8/2021 | Maselino | A43C 1/06 |
| 2021/0267306 | A1 | 9/2021 | Sakaguchi et al. | |
| 2022/0022597 | A1* | 1/2022 | Bowman | A43B 13/141 |
| 2023/0200486 | A1* | 6/2023 | Kajiwara | A43B 13/122 36/25 R |
| 2023/0255304 | A1* | 8/2023 | Chen | A43B 3/0031 36/136 |

* cited by examiner

SOLE AND SHOE

REFERENCE TO RELATED APPLICATIONS

This nonprovisional application is based on Japanese Patent Application No. 2023-032622 filed on Mar. 3, 2023 with the Japan Patent Office, the entire contents of which are hereby incorporated by reference.

BACKGROUND

Technical Field

The present disclosure relates to a sole and a shoe.

Background Information

Shoes worn in sports and the like are required to reduce fatigue of the feet during running and exercising. For example, PCT International Publication No. 2020/136916 discloses a shoe capable of reducing a burden on an ankle joint. The sole of the shoe includes a rear bottom surface portion that, when placed on the flat virtual plane, comes into contact with the virtual plane, a toe portion having a height from the virtual plane that is greater than or equal to 170% and less than or equal to 250% with respect to a thickness dimension in the rear bottom surface portion, and a front bottom surface portion that is continuous with a front portion of the rear bottom surface portion, extends to the toe portion in a curved manner, and is separated from the virtual plane.

SUMMARY

In the shoe described in PCT International Publication No. 2020/136916, it is desirable to further reduce the burden on the foot by suppressing the movement of the ankle joint from the time of landing to the time of taking off.

An object of the present disclosure is to provide a sole and a shoe capable of reducing a change in angle of an ankle joint from landing to taking off.

A sole according to one aspect of the present disclosure is a sole constituting a part of a shoe, the sole including: a midsole that is configured to support a wearer's foot, in which the midsole includes: a toe support portion that is configured to support a toe of the wearer's foot; a midfoot support portion that is configured to support a midfoot portion of the wearer's foot; and an intervening portion interposed between the toe support portion and the midfoot support portion, the sole includes: a toe contact surface that overlaps the toe support portion in a thickness direction of the sole and constitutes a contact surface; and a midfoot contact surface that overlaps the midfoot support portion in the thickness direction and constitutes a contact surface, the intervening portion includes a recessed portion having a shape recessed toward the wearer's foot from an imaginary curved surface connecting the toe contact surface and the midfoot contact surface, a length between the imaginary curved surface and the recessed portion is greater than or equal to 13% and less than or equal to 50% of a thickness of a portion of the intervening portion where the recessed portion is provided, the midsole has a front side region surrounded by a front line and a rear line, the front line passing through a first portion that is located on a shoe center and at 5% of a total length of the midsole from a front end portion of the midsole toward a rear side in a foot length direction of the sole, and being orthogonal to the shoe center, the rear line passing through a second portion that is located on the shoe center and at 30% of the total length of the midsole from the front end portion toward the rear side in the foot length direction, and being orthogonal to the shoe center, and an area of the recessed portion in plan view is greater than or equal to 35% and less than or equal to 50% of an area of the front side region in plan view.

Further, a shoe according to one aspect of the present disclosure includes: the sole; and the upper connected to the sole and providing, together with the sole, an accommodation space for the wearer's foot.

The foregoing and other objects, features, aspects and advantages of the present invention will become more apparent from the following detailed description of the present invention when taken in conjunction with the accompanying drawings.

DETAILED DESCRIPTION

Figure 1:
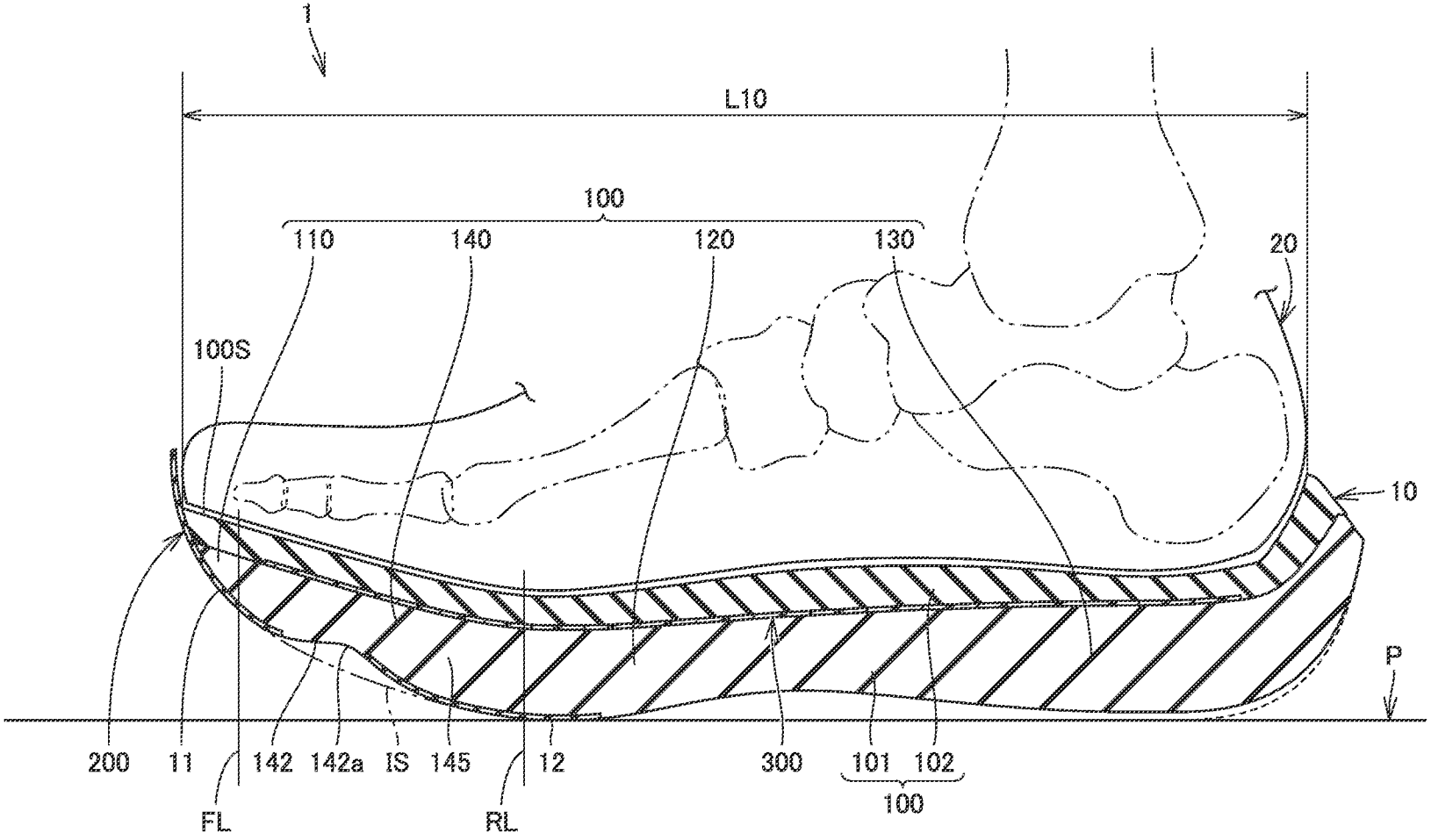
FIG. 1 is a cross-sectional view schematically illustrating a shoe in one embodiment of the present disclosure.

An embodiment of the present disclosure will be described with reference to the drawings. In the drawings hereinafter referred to, the same or corresponding members are denoted by the same reference numerals. In the following description, terms such as a foot length direction, a foot width direction, a front side, and a rear side are used. Terms indicating these directions indicate directions as viewed from a viewpoint of a wearer wearing a shoe 1 placed on a flat surface P (see FIG. 1) such as the ground. For example, the front side refers to a toe side and the rear side refers to a heel side. In addition, an inner side or an inner foot side refers to a side of the first toe (thumb) of the foot in the foot width direction, and an outer side or an outer foot side refers to a side of the fifth toe of the foot in the foot width direction.

Figure 2:
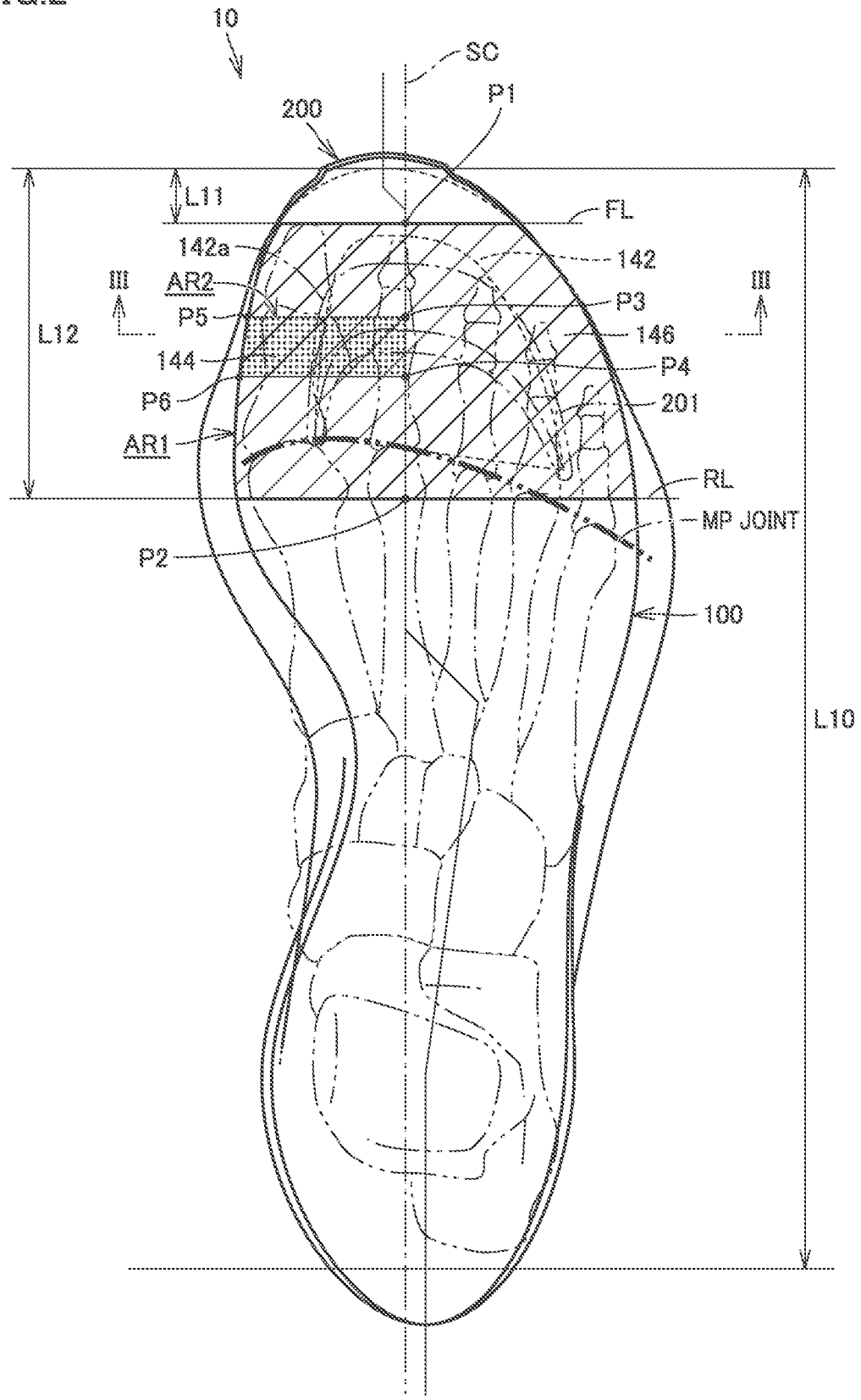
FIG. 2 is a plan view of a sole.

FIG. 1 is a cross-sectional view schematically illustrating a shoe in one embodiment of the present disclosure. FIG. 2 is a plan view of a sole. FIG. 2 shows a sole 10 for the right foot, but the sole 10 is also applicable to the left foot. In this case, the sole for the left foot is in a shape symmetrical with or substantially similar to the sole for the right foot.

The shoe 1 in the present embodiment is suitable, for example, for running, but can also be applicable to other sports shoes or walking shoes, and the use of the shoe 1 is not limited.

As illustrated in FIG. 1, the shoe 1 includes the sole 10 and an upper 20.

The upper 20 is connected to the sole 10. The upper 20 and the sole 10 provide an accommodation space for a wearer's foot. The upper 20 covers an upper surface of the wearer's foot.

The sole 10 constitutes a part of the shoe 1. The sole 10 is connected to a lower portion of the upper 20. The sole 10 is connected to the upper 20 by adhesion, for example. As shown in FIG. 1, the sole 10 includes a midsole 100, an outsole 200, and a plate 300.

The midsole 100 has a cushioning function at the time of landing, a repulsive function at the time of taking off, and the like. The midsole 100 is preferably made of resin, rubber, or the like having an appropriate strength and excellent buffering property. The midsole 100 is made of, for example, a resin foam. Examples of the resin constituting the midsole 100 include a polyamide-based thermoplastic elastomer (TPA, TPAE), a thermoplastic polyurethane (TPU), a polyester-based thermoplastic elastomer (TPEE), and an ethylene-vinyl acetate copolymer (EVA). As illustrated in FIG. 1, the midsole 100 has an upper connection surface 100S to which the upper 20 is connected.

As illustrated in FIG. 1, the midsole 100 includes a toe support portion 110, a midfoot support portion 120, a rearfoot support portion 130, and an intervening portion 140.

The toe support portion 110 is a portion that supports a toe of the wearer's foot. The toe support portion 110 is a portion of the midsole 100 between a front end portion of the upper connection surface 100S of the midsole 100 in the foot length direction and a position of 5% of a total length L10 of the upper connection surface 100S in the foot length direction toward the rear side from the front end portion of the upper connection surface 100S.

Here, the foot length direction is a direction parallel to a shoe center SC (see FIG. 2). The shoe center SC is not limited to the center line of the shoe 1, and may be a line that overlaps a straight line passing through the center of the calcaneus of the standard wearer of the shoe 1 and a portion between the first toe and the second toe, and the thickness direction of the sole 10.

The midfoot support portion 120 is a portion that supports a midfoot portion of the wearer's foot. The midfoot support portion 120 is a portion of the midsole 100 between a position of 30% of the total length L10 of the upper connection surface 100S toward the rear side from the front end portion of the upper connection surface 100S in the foot length direction and a position of 60% of the total length L10 of the upper connection surface 100S in the foot length direction toward the rear side from the front end portion of the upper connection surface 100S in the foot length direction.

The rearfoot support portion 130 is a portion that supports a rearfoot portion of the wearer's foot. The rearfoot support portion 130 is a portion of the midsole 100 between a position of 60% of the total length L10 of the upper connection surface 100S in the foot length direction toward the rear side from the front end portion of the upper connection surface 100S in the foot length direction and a rear end portion of the upper connection surface 100S in the foot length direction.

The intervening portion 140 is a portion interposed between the toe support portion 110 and the midfoot support portion 120. The intervening portion 140 includes an overlapping portion 145 that overlaps an MP joint of the wearer's foot in the thickness direction of the sole 10.

The outsole 200 is connected to a lower surface of the midsole 100. The outsole 200 is made of rubber, resin, or the like. The outsole 200 may roughly cover the entire lower surface of the midsole 100, or may cover only a part of the lower surface of the midsole 100.

The plate 300 is disposed within the midsole 100. In the present embodiment, as shown in FIG. 1, the midsole 100 has a lower midsole 101 and an upper midsole 102, and the plate 300 is disposed between the lower midsole 101 and the upper midsole 102.

The plate 300 has a shape extending from the toe support portion 110 to the midfoot support portion 120 in the foot length direction. In the present embodiment, as shown in FIG. 1, the plate 300 has a shape extending from the toe support portion 110 to the rearfoot support portion 130.

The flexural rigidity of the plate 300 is larger than a flexural rigidity of the midsole 100. The plate 300 has a function of increasing the flexural rigidity of the sole 10, a function of uniformly applying a load to portions of the midsole 100 located below the plate 300 (the lower midsole 101 in the present embodiment), and the like. The plate 300 is made of a fiber-reinforced resin or a non-fiber-reinforced resin. Examples of fiber used for the fiber-reinforced resin include carbon fiber, glass fiber, aramid fiber, Dyneema fiber (registered trademark), Zylon fiber (registered trademark), and boron fiber. In the present embodiment, carbon fibers are used as the fibers.

Figure 3:
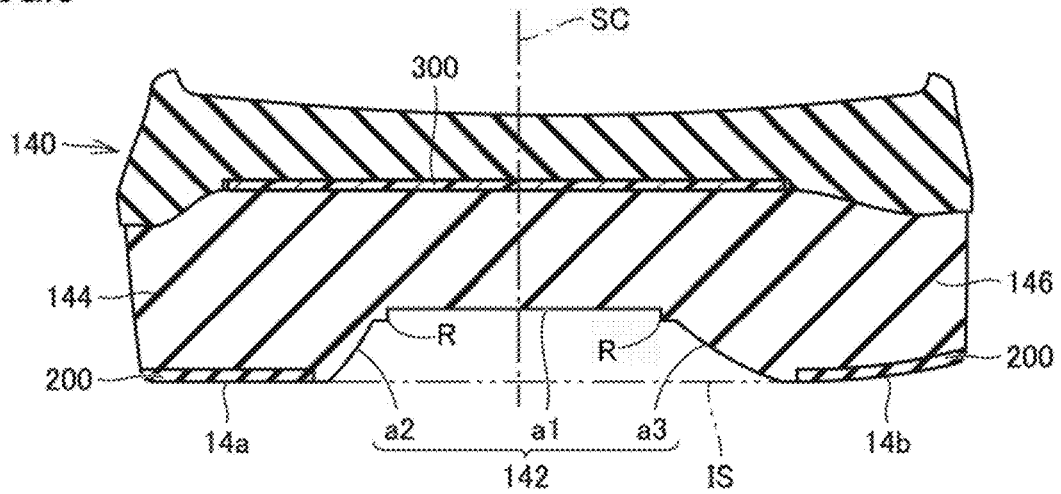
FIG. 3 is a cross-sectional view taken along line III-III in FIG. 2.
Figure 4:
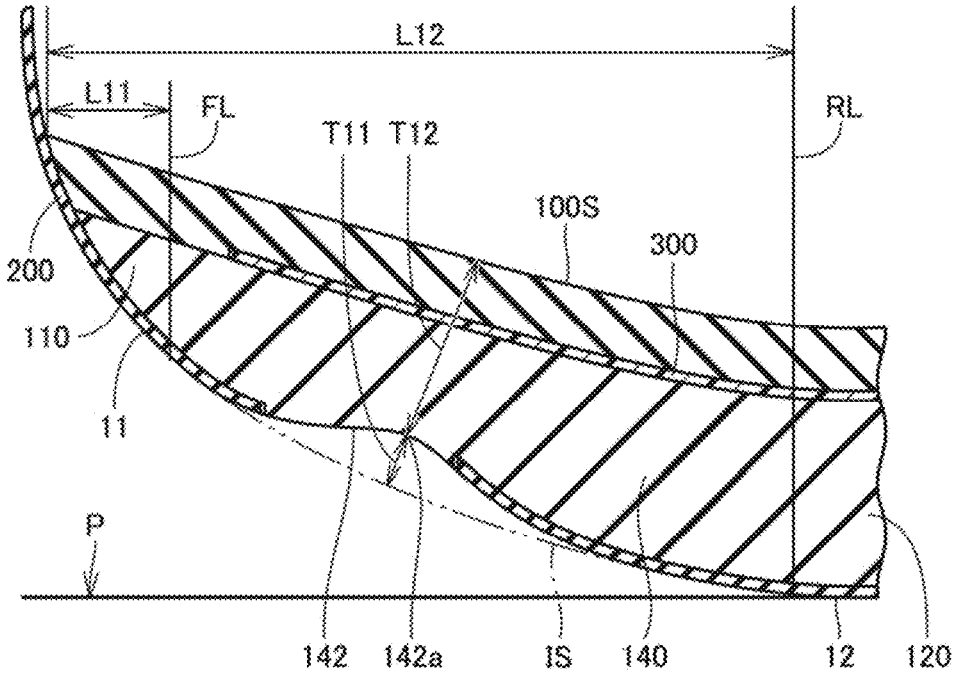
FIG. 4 is an enlarged view near an intervening portion.

As shown in FIGS. 1, 3, and 4, the sole 10 has a toe contact surface 11 and a midfoot contact surface 12.

The toe contact surface 11 overlaps the toe support portion 110 in the thickness direction and constitutes a contact portion. The toe contact surface 11 has a shape curved to protrude toward the flat surface P in a state where the sole 10 is placed on the flat surface P. In the present embodiment, the toe contact surface 11 is configured by a lower surface of the outsole 200. However, the outsole 200 may not be provided on a lower surface of the toe support portion 110, and the toe contact surface 11 may be configured by the lower surface of the toe support portion 110.

The midfoot contact surface 12 overlaps the midfoot support portion 120 in the thickness direction and constitutes the contact portion. The midfoot contact surface 12 has a shape curved to protrude toward the flat surface P in a state where the sole 10 is placed on the flat surface P. In the present embodiment, the midfoot contact surface 12 is configured by the lower surface of the outsole 200. However, the outsole 200 may not be provided on a lower surface of the midfoot support portion 120, and the midfoot contact surface 12 may be configured by the lower surface of the midfoot support portion 120.

As illustrated in FIGS. 1 to 3, the intervening portion 140 includes a recessed portion 142, an inner connecting portion 144, and an outer connecting portion 146. In FIG. 2, the recessed portion 142 is indicated by a broken line, and a boundary 201 between the outsole 200 and the recessed portion 142 is indicated by a two-dot chain line.

The recessed portion 142 has a shape recessed toward a side of the wearer's foot from an imaginary curved surface IS connecting the toe contact surface 11 and the midfoot contact surface 12. The recessed portion 142 is disposed in a central portion in the foot width direction. As illustrated in FIGS. 1 and 3, the recessed portion 142 is disposed in the lower midsole 101. The recessed portion 142 may or may not be covered with the outsole 200. When the recessed portion 142 is covered with the outsole 200, the lower surface of the outsole 200 is positioned closer to the side of the wearer's foot than to the imaginary curved surface IS.

The inner connecting portion 144 is disposed inside the recessed portion 142 in the foot width direction (left side in FIG. 3). The inner connecting portion 144 connects the toe support portion 110 and the midfoot support portion 120. As shown in FIG. 3, the sole 10 has an inner contact surface 14*a* that overlaps the inner connecting portion 144 in the thickness direction and constitutes the contact portion. The inner contact surface 14*a* matches the imaginary curved surface IS. In the present embodiment, the inner contact surface 14*a* is configured by the lower surface of the outsole 200.

However, the outsole 200 disposed below the inner connecting portion 144 may be omitted, and the inner contact surface 14*a* may be configured by a lower surface of the inner connecting portion 144.

The outer connecting portion 146 is provided outside the recessed portion 142 in the foot width direction (right side in FIG. 3). The outer connecting portion 146 connects the toe support portion 110 and the midfoot support portion 120. As shown in FIG. 3, the sole 10 has an outer contact surface 14*b* that overlaps the outer connecting portion 146 in the thickness direction and constitutes the contact portion. The outer contact surface 14*b* matches the imaginary curved surface IS. In the present embodiment, the outer contact surface 14*b* is configured by the lower surface of the outsole 200. However, the outsole 200 disposed below the outer connecting portion 146 may be omitted, and the outer contact surface 14*b* may be configured by a lower surface of the outer connecting portion 146.

As illustrated in FIG. 4, a length T11 between the imaginary curved surface IS and the recessed portion 142 is greater than or equal to 13% and less than or equal to 50% of a thickness T12 of a portion of the intervening portion 140 where the recessed portion 142 is provided.

An area of the recessed portion 142 in plan view (the area of the recessed portion 142 indicated by a broken line in FIG. 2) is greater than or equal to 35% and less than or equal to 50% of an area of a front side region AR1 in plan view (the area of a hatched region in FIG. 2). The front side region AR1 is a part of the midsole 100. The front side region AR1 is an area surrounded by a front line FL and a rear line RL.

The front line FL is a line passing through a first portion P1 that is located on the shoe center SC and at a position of a first length L11 from the front end portion of the upper connection surface 100S toward the rear side in the foot length direction, and being orthogonal to the shoe center SC. The first length L11 is 5% of the total length L10 of the upper connection surface 100S.

The rear line RL is a line that is located on the shoe center SC, passes through a second portion P2 located at a position of a second length L12 from the front end portion of the upper connection surface 100S of the midsole 100 toward the rear side in the foot length direction, and is orthogonal to the shoe center SC. The second length L12 is 30% of the total length L10 of the upper connection surface 100S.

As illustrated in FIG. 2, the front end of the recessed portion 142 in the foot length direction is positioned on the rear side of the front line FL, and the rear end of the recessed portion 142 in the foot length direction is positioned on the front side of the rear line RL.

The recessed portion 142 is configured by a single upward convex surface (hereinafter, referred to as "upward convex surface 142") having a shape protruding from the imaginary curved surface IS toward the wearer's foot. The upward convex surface 142 has a shape curved to protrude toward the wearer's foot from the imaginary curved surface IS. The upward convex surface 142 includes a top portion 142*a*. The length T11 means a dimension between the imaginary curved surface IS and the top portion 142*a*. In FIG. 2, the top portion 142*a* is indicated by a one-dot chain line.

As illustrated in FIG. 3, the upward convex surface 142 has a central convex surface a1, an inner convex surface a2, and an outer convex surface a3.

The central convex surface a1 includes the top portion 142*a*. As illustrated in FIG. 1, the top portion 142*a* is provided on the front side of the overlapping portion 145 in the foot length direction. At least a part of the top portion 142*a* is provided in a thenar front region AR2 (see FIG. 2) of the midsole 100. In FIG. 2, the thenar front region AR2 is indicated by a dot pattern.

The thenar front region AR2 is a region that overlaps a portion on the front side of the thumb MP joint of the standard wearer's foot of the shoe 1 in the thickness direction. The thenar front region AR2 is a region surrounded by a third portion P3, a fourth portion P4, a fifth portion P5 and a sixth portion P6.

The third portion P3 is a portion located on the shoe center SC and at 13% of the total length L10 of the upper connection surface 100S from the front end portion of the upper connection surface 100S toward the rear side in the foot length direction.

The fourth portion P4 is a portion located on the shoe center SC and at 18% of the total length L10 of the upper connection surface 100S from the front end portion of the upper connection surface 100S toward the rear side in the foot length direction.

The fifth portion P5 is an intersection between a straight line orthogonal to the shoe center SC and passing through the third portion P3 and an end portion on the medial foot side of the midsole 100 in the foot width direction.

The sixth portion P6 is an intersection between a straight line orthogonal to the shoe center SC and passing through the fourth portion P4 and an end portion on the medial foot side of the midsole 100 in the foot width direction.

The inner convex surface a2 connects the central convex surface a1 and the inner contact surface 14*a*. The inner convex surface a2 has a shape inclined to approach the imaginary curved surface IS gradually as being separated from the central convex surface a1 in the foot width direction. In the present embodiment, the inner convex surface a2 includes the top portion 142*a*.

The outer convex surface a3 connects the central convex surface a1 and the outer contact surface 14*b*. The outer convex surface a3 has a shape inclined to approach the imaginary curved surface IS gradually as being separated from the central convex surface a1 in the foot width direction. In the present embodiment, the outer convex surface a3 includes the top portion 142*a*.

Each of the inner convex surface a2 and the outer convex surface a3 may be substantially orthogonal to the imaginary curved surface IS. In this case, the top portion 142*a* may be disposed only on the central convex surface a1.

Figure 5:
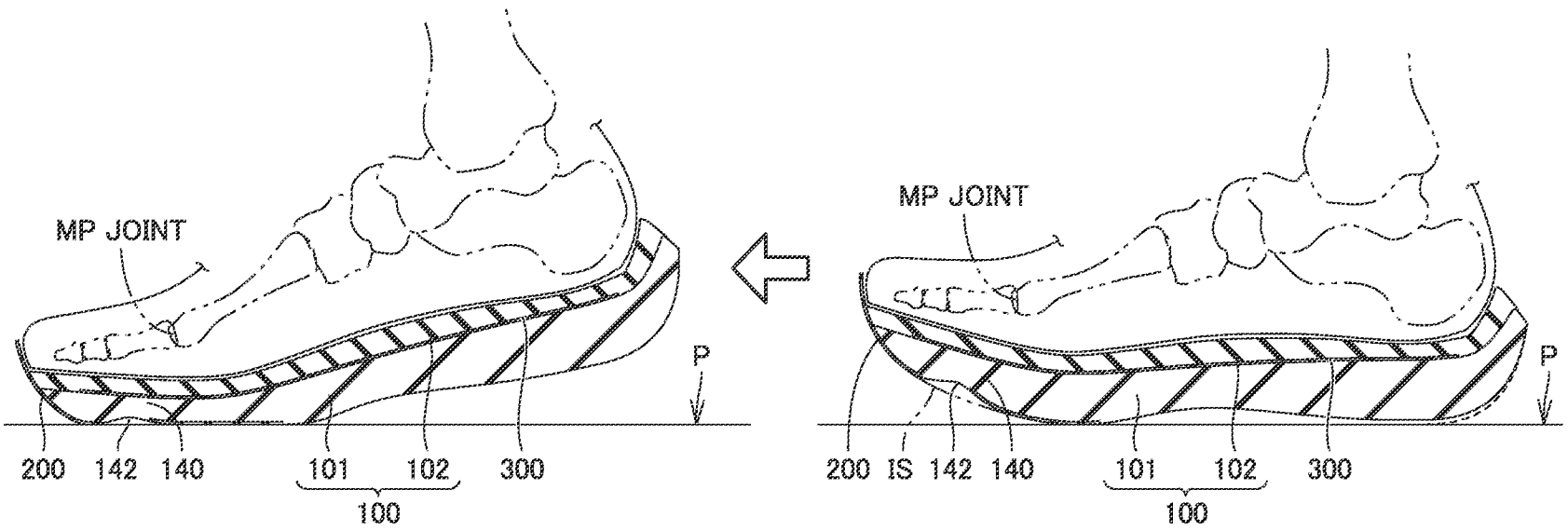
FIG. 5 is a diagram schematically illustrating a process from landing to taking off.

Next, changes in the shapes of the intervening portion 140 from the time of landing to the time of taking off will be described with reference to FIG. 5.

From the time of landing to the time before taking off, a large load does not act on the intervening portion 140 from the MP joint of the wearer's foot. On the other hand, at the time of taking off, a large load acts on the intervening portion 140 from the MP joint of the wearer's foot. Therefore, a particularly large compressive load acts on a portion around the recessed portion 142 of the midsole 100.

In the present embodiment, the length T11 between the imaginary curved surface IS and the recessed portion 142 is greater than or equal to 13% of the thickness T12 of the portion of the intervening portion 140 where the recessed portion 142 is provided, and the area of the recessed portion 142 in the plan view is greater than or equal to 35% of the area of the front side region AR1 in the plan view. Therefore, at the time of taking off, the portion of the midsole 100 around the recessed portion 142 is mainly compressed and deformed relatively largely while the grounding of the recessed portion 142 is suppressed. As a result, a decrease in the angle of the ankle joint of the wearer at the time of taking off is suppressed, and thus a change in the angle of the ankle joint from the time of landing to the time of taking off is reduced. Therefore, a load on the foot during traveling or the like is reduced.

In addition, since the length T11 is less than or equal to 50% of the thickness T12, the flexural rigidity of the midsole 100 necessary for traveling is effectively secured. On the other hand, since the flexural rigidity of the sole 10 is lowered by providing the recessed portion 142 as compared with the case where the recessed portion 142 is not provided, the cushioning property at the time of landing is secured and the compressive load is suppressed from becoming locally too high in the case of landing from the lateral foot side or the medial foot side.

Furthermore, since the area of the recessed portion 142 in plan view is less than or equal to 50% of the area of the front side region AR1 in plan view, stability at the time of taking off is effectively secured.

In addition, since the plate 300 is positioned on the recessed portion 142, the load acting on the portion of the midsole 100 around the recessed portion 142 through the plate 300 is equalized at the time of taking off. As a result, a range of deformation of the portion of the midsole 100 around the recessed portion 142 becomes large as compared with the case where the plate 300 is not provided. Even when a large load acts on the sole 10, the bottom touch feeling felt by the wearer is reduced. The plate 300 improves the stability of the foot portion at the time of landing and taking off, and since the plate 300 is across the recessed portion 142 in the foot length direction, the wearer is less likely to feel a local change in hardness around the recessed portion 142.

Hereinafter, modified examples of the above embodiment will be described with reference to FIGS. 6 to 10.

First Modified Example

Figure 6:
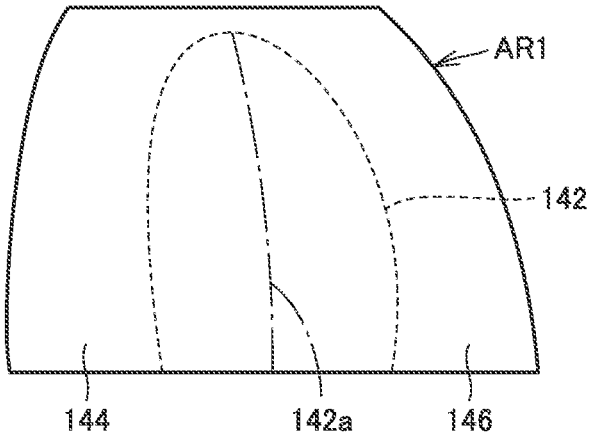
FIG. 6 is a plan view of the sole schematically showing a modified example of the recessed portion.

As illustrated in FIG. 6, the recessed portion 142 may be provided in a shape extending long in the foot length direction. In this case, the top portion 142*a* also has a shape extending in the foot length direction. The front end of the recessed portion 142 in the foot length direction is positioned on the rear side of the front line FL, and the rear end of the recessed portion 142 in the foot length direction is positioned on the rear line RL.

Second Modified Example

Figure 7:
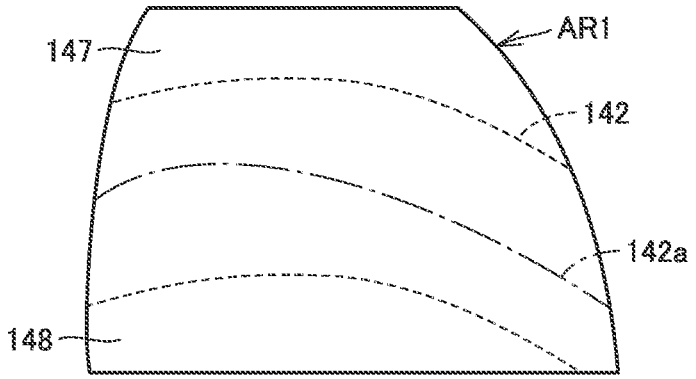
FIG. 7 is a plan view of the sole schematically showing a modified example of the recessed portion.

As illustrated in FIG. 7, the recessed portion 142 may have a shape extending from an inner end portion to an outer end portion in the foot width direction. In this case, the top portion 142*a* also has a shape extending from an inner end portion to an outer end portion in the foot width direction. It is desirable that a curvature of the top portion 142*a* is close to a curvature of the MP joint of the wearer's foot.

The intervening portion 140 includes a front intervening portion 147 disposed on the front side of the recessed portion 142 in the foot length direction and a rear intervening portion 148 disposed on the rear side of the recessed portion 142 in the foot length direction.

The contact surface provided at a position overlapping each of the front intervening portion 147 and the rear intervening portion 148 in the sole 10 matches the imaginary curved surface IS.

In this aspect, transition to a take-off phase from grounding is facilitated.

Third Modified Example

Figure 8:
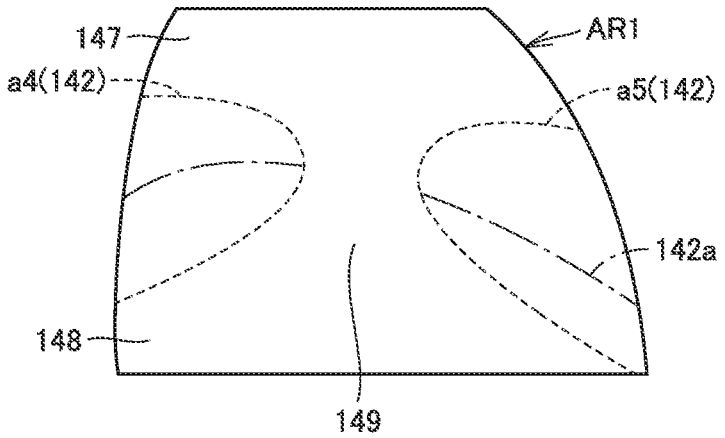
FIG. 8 is a plan view of the sole schematically showing a modified example of the recessed portion.

As illustrated in FIG. 8, the recessed portion 142 may have an inner recessed portion a4 provided on the inner side in the foot width direction and an outer recessed portion a5 formed on the outer side in the foot width direction.

The intervening portion 140 has a central connecting portion 149 provided between the inner recessed portion a4 and the outer recessed portion a5. The central connecting portion 149 connects the front intervening portion 147 and the rear intervening portion 148.

The contact surface provided at a position overlapping each of the front intervening portion 147, the rear intervening portion 148, and the central connecting portion 149 in the sole 10 matches the imaginary curved surface IS.

In this aspect, transition to a take-off phase from grounding is facilitated.

Fourth Modified Example

Figure 9:
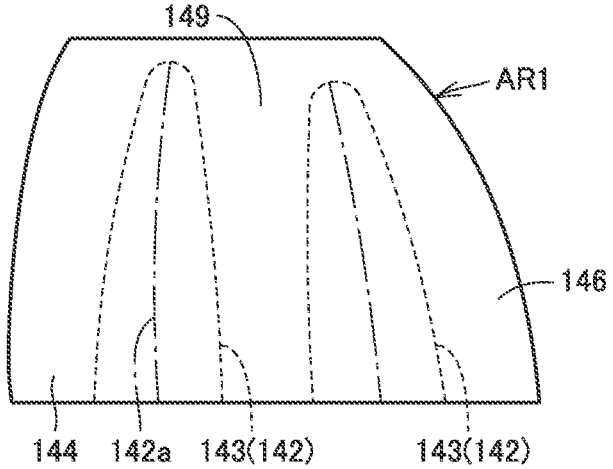
FIG. 9 is a plan view of the sole schematically showing a modified example of the recessed portion.
Figure 10:
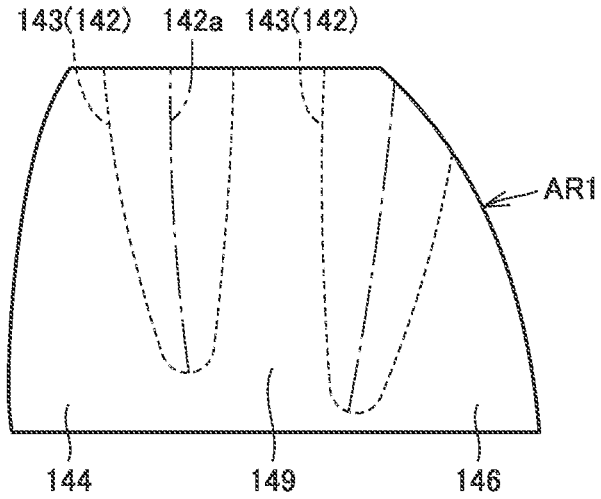
FIG. 10 is a plan view of the sole schematically showing a modified example of the recessed portion.

As illustrated in FIGS. 9 and 10, the recessed portion 142 may have a pair of concave portions 143 provided at positions separated from each other in the foot width direction. Each of the concave portions 143 has a shape extending long in the foot length direction. In the example illustrated in FIG. 9, the front end of each of the concave portions 143 in the foot length direction is positioned on the rear side of the front line FL, and the rear end of each of the concave portions 143 in the foot length direction is positioned on the rear line RL. In the example illustrated in FIG. 10, the front end of the concave portion 143 disposed inside in the foot length direction matches the front line FL, the front end of the concave portion 143 provided outside in the foot length direction matches the outside line in the foot width direction of the front line FL or the front side region AR1, and the rear end of each of the concave portions 143 in the foot length direction is positioned on the front side of the rear line RL.

The intervening portion 140 includes the inner connecting portion 144, the outer connecting portion 146, and the central connecting portion 149. The inner connecting portion 144 is disposed inside the pair of concave portions 143 in the foot width direction, and connects the toe support portion 110 and the midfoot support portion 120. The outer connecting portion 146 is disposed outside the pair of concave portions 143 in the foot width direction, and connects the toe support portion 110 and the midfoot support portion 120. The central connecting portion 149 is disposed between the pair of concave portions 143, and connects the toe support portion 110 and the midfoot support portion 120.

The contact surface provided at a position overlapping each of the inner connecting portion 144, the outer connecting portion 146, and the central connecting portion 149 in the sole 10 matches the imaginary curved surface IS.

Fifth Modified Example

The recessed portion 142 may include, for example, a plurality of through holes (not illustrated) penetrating the lower midsole 101 in the thickness direction of the lower midsole 101. In this case, the contact surface of the sole 10 provided at a position overlapping the recessed portion 142 in the thickness direction may match the imaginary curved surface IS.

It is understood by those skilled in the art that the exemplary embodiment described above is a specific example of the following aspects.

[Aspect 1]

A sole constituting a part of a shoe, the sole including a midsole that is configured to support a wearer's foot, in which the midsole includes:

a toe support portion that is configured to support a toe of the wearer's foot;

a midfoot support portion that is configured to support a midfoot portion of the wearer's foot; and an intervening portion interposed between the toe support portion and the midfoot support portion, the sole includes:

a toe contact surface that overlaps the toe support portion in a thickness direction of the sole and constitutes a contact surface; and a midfoot contact surface that overlaps the midfoot support portion in the thickness direction and constitutes a contact surface, the intervening portion includes a recessed portion having a shape recessed toward the wearer's foot from an imaginary curved surface connecting the toe contact surface and the midfoot contact surface, a length between the imaginary curved surface and the recessed portion is greater than or equal to 13% and less than or equal to 50% of a thickness of a portion of the intervening portion where the recessed portion is provided, the midsole has a front side region surrounded by a front line and a rear line, the front line passing through a first portion that is located on a shoe center and at 5% of a total length of the midsole from a front end portion of the midsole toward a rear side in a foot length direction of the sole, and being orthogonal to the shoe center, and the rear line passing through a second portion that is located on the shoe center and at 30% of the total length of the midsole from the front end portion toward the rear side in the foot length direction, and being orthogonal to the shoe center, and an area of the recessed portion in plan view is greater than or equal to 35% and less than or equal to 50% of an area of the front side region in plan view.

Generally, at the time of taking off in a running motion or the like, a large load acts on the sole from a front portion of the MP joint of the wearer's foot. In this sole, the intervening portion interposed between the toe support portion and the midfoot support portion has the recessed portion, the length between the imaginary curved surface and the recessed portion is greater than or equal to 13% of the thickness of the portion of the intervening portion where the recessed portion is provided, and the area of the recessed portion in plan view is greater than or equal to 35% of the area of the front side region in plan view. Therefore, at the time of taking off, the portion of the midsole around the recessed portion is mainly compressed and deformed relatively largely while grounding of the recessed portion is suppressed. As a result, a decrease in the angle of the ankle joint of the wearer at the time of taking off is suppressed, and thus a change in the angle of the ankle joint from the time of landing to the time of taking off is reduced. Therefore, a load on the foot during traveling or the like is reduced.

In addition, since the length between the imaginary curved surface and the recessed portion is less than or equal to 50% of the thickness of the portion of the intervening portion where the recessed portion is provided, the flexural rigidity of the midsole 100 necessary for traveling is effectively secured. Furthermore, since the area of the recessed portion in plan view is less than or equal to 50% of the area of the front side region in plan view, stability at the time of taking off is effectively secured.

[Aspect 2]

The sole according to the first aspect, in which the recessed portion is constituted by a single upward convex surface having a shape protruding from the imaginary curved surface toward the wearer's foot.

[Aspect 3]

The sole according to the second aspect, in which the upward convex surface has a shape curved to protrude toward the wearer's foot from the imaginary curved surface, and the upward convex surface has a top portion.

[Aspect 4]

The sole according to the third aspect, in which the midsole includes a thenar front region surrounded by a third portion, a fourth portion, a fifth portion, and a sixth portion, the third portion being located on the shoe center and at 13% of the total length of the midsole from the front end portion toward the rear side in the foot length direction, the fourth portion being located on the shoe center and at 18% of the total length of the midsole from the front end portion toward the rear side in the foot length direction, the fifth portion being an intersection between a straight line orthogonal to the shoe center and passing through the third portion and an end portion of the midsole on a medial foot side in a foot width direction of the sole, and the sixth portion being an intersection between a straight line orthogonal to the shoe center and passing through the fourth portion and an end portion of the midsole on the medial foot side in the foot width direction, and at least a part of the top portion is disposed in the thenar front region.

In this aspect, since at least a part of the top portion is provided in the thenar front region where a relatively large compressive load acts at the time of taking off, an angular change of the ankle joint from the time of landing to the time of taking off is further reduced.

[Aspect 5]

The sole according to the third aspect or the fourth aspect, in which the intervening portion includes an overlapping portion that is configured to overlap an MP joint of the wearer's foot in the thickness direction of the sole, and the top portion is disposed on a front side of the overlapping portion in the foot length direction.

[Aspect 6]

The sole according to any one of the first to the fifth aspects, in which the recessed portion is disposed in a central portion in a foot width direction of the sole, the intervening portion further includes:

an inner connecting portion disposed inside the recessed portion in the foot width direction and connecting the toe support portion and the midfoot support portion; and an outer connecting portion disposed outside the recessed portion in the foot width direction and connecting the toe support portion and the midfoot support portion, and the sole includes a contact surface that overlaps each of the inner connecting portion and the outer connecting portion in the thickness direction, and matches the imaginary curved surface.

In this aspect, transition to the take-off phase is facilitated by load movement while improving a shock absorbing property and stability at the time of landing.

[Aspect 7]

The sole according to the sixth aspect, in which the upward convex surface includes:

a central convex surface including the top portion;

an inner convex surface connecting the central convex surface and the contact surface disposed below the inner connecting portion; and an outer convex surface connecting the central convex surface and the contact surface disposed below the outer connecting portion, and each of the inner convex surface and the outer convex surface has a shape inclined to approach the imaginary curved surface gradually as being separated from the central convex surface in the foot width direction.

In this aspect, the shock absorbing property and the stability at the time of landing are further improved.

[Aspect 8]

The sole according to any one of the first to the fifth aspects, in which the recessed portion has a shape extending from an inner end portion to an outer end portion in a foot width direction of the sole.

In this aspect, transition to a take-off phase from grounding is facilitated.

[Aspect 9]

The sole according to any one of the first to the fifth aspects, in which the recessed portion includes a pair of concave portions disposed at positions separated from each other in a foot width direction of the sole, each of the pair of concave portions has a shape extending long in the foot length direction, the intervening portion includes:

a central connecting portion disposed between the pair of concave portions and connecting the toe support portion and the midfoot support portion;

an inner connecting portion disposed inside the pair of concave portions in the foot width direction and connecting the toe support portion and the midfoot support portion; and an outer connecting portion disposed outside the pair of concave portions in the foot width direction and connecting the toe support portion and the midfoot support portion, and the sole includes a contact surface that overlaps each of the central connecting portion, the inner connecting portion, and the outer connecting portion in the thickness direction, and matches the imaginary curved surface.

[Aspect 10]

The sole according to any one of the first to the ninth aspects, further including a plate arranged inside the midsole and having a flexural rigidity greater than a flexural rigidity of the midsole, in which the plate is arranged on the recessed portion and has a shape crossing over the recessed portion in the foot length direction.

In this aspect, since the plate is positioned on the recessed portion, the load acting on the portion of the midsole around the recessed portion through the plate is equalized at the time of taking off. As a result, a range of deformation of the portion of the midsole around the recessed portion becomes large as compared with the case where the plate is not provided. Even when a large load acts on the sole, the bottom touch feeling felt by the wearer is reduced. Further, the plate improves the stability of the foot portion at the time of landing and taking off, and since the plate is across the recessed portion in the foot length direction, the wearer is less likely to feel a local change in hardness around the recessed portion.

[Aspect 11]

A shoe including:

the sole according to any one of the first to the tenth aspects; and an upper connected to the sole and providing, together with the sole, an accommodation space for the wearer's foot.

[Aspect 12]

The sole according to the third aspect, wherein the top portion includes a ridge extending in the foot width direction of the shoe or in the foot length direction of the shoe.

Although the present invention has been described and illustrated, it is understood that the embodiment disclosed herein is by way of illustration and example only and is not to be taken by way of limitation. The scope of the present invention is interpreted by the terms of the appended claims, and it is intended that meanings equivalent to the claims and all modifications within the scope are included.

What is claimed is:

1. A sole constituting a part of a shoe, the sole comprising a midsole that is configured to support a wearer's foot, wherein the midsole includes:

a toe support portion that is configured to support a toe of the wearer's foot;

a midfoot support portion that is configured to support a midfoot portion of the wearer's foot; and an intervening portion interposed between the toe support portion and the midfoot support portion, the sole includes:

a toe contact surface that overlaps the toe support portion in a thickness direction of the sole and constitutes a contact surface; and a midfoot contact surface that overlaps the midfoot support portion in the thickness direction and constitutes a contact surface, the intervening portion includes a recessed portion having a shape recessed toward the wearer's foot from an imaginary curved surface connecting the toe contact surface and the midfoot contact surface, a length between the imaginary curved surface and the recessed portion is greater than or equal to 13% and less than or equal to 50% of a thickness of a portion of the intervening portion where the recessed portion is provided, the midsole has a front side region surrounded by a front line and a rear line, the front line passing through a first portion that is located on a shoe center and at 5% of a total length of the midsole from a front end portion of the midsole toward a rear side in a foot length direction of the sole, and being orthogonal to the shoe center, and the rear line passing through a second portion that is located on the shoe center and at 30% of the total length of the midsole from the front end portion toward the rear side in the foot length direction, and being orthogonal to the shoe center, an area of the recessed portion in plan view is greater than or equal to 35% and less than or equal to 50% of an area of the front side region in plan view, and the recessed portion is entirely positioned in a region extending greater than the 5% and less than the 30% of the total length of the midsole from the front end portion of the midsole toward the rear side in the foot length direction.

2. The sole according to claim 1, wherein the recessed portion is constituted by a single upward convex surface having a shape protruding from the imaginary curved surface toward the wearer's foot.

3. The sole according to claim 1, wherein the recessed portion includes an upward convex surface having a shape protruding from the imaginary curved surface toward the wearer's foot, the upward convex surface includes a shape curved to protrude toward the wearer's foot from the imaginary curved surface, and the upward convex surface has a top portion.

4. The sole according to claim 3, wherein the midsole includes a thenar front region surrounded by a third portion, a fourth portion, a fifth portion, and a sixth portion, the third portion being located on the shoe center and at 13% of the total length of the midsole from the front end portion toward the rear side in the foot length direction, the fourth portion being located on the shoe center and at 18% of the total length of the midsole from the front end portion toward the rear side in the foot length direction, the fifth portion being an intersection between a straight line orthogonal to the shoe center and passing through the third portion and an end portion of the midsole on a medial foot side in a foot width direction of the sole, and the sixth portion being an intersection between a straight line orthogonal to the shoe center and passing through the fourth portion and an end portion of the midsole on the medial foot side in the foot width direction, and at least a part of the top portion is disposed in the thenar front region.

5. The sole according to claim 3, wherein the intervening portion includes an overlapping portion that is configured to overlap an MP joint of the wearer's foot in the thickness direction of the sole, and the top portion is disposed on a front side of the overlapping portion in the foot length direction.

6. The sole according to claim 3, wherein the recessed portion is disposed in a central portion in a foot width direction of the sole, the intervening portion further includes:

an inner connecting portion disposed inside the recessed portion in the foot width direction and connecting the toe support portion and the midfoot support portion; and an outer connecting portion disposed outside the recessed portion in the foot width direction and connecting the toe support portion and the midfoot support portion, and the sole includes a contact surface that overlaps each of the inner connecting portion and the outer connecting portion in the thickness direction, and matches the imaginary curved surface.

7. The sole according to claim 6, wherein the upward convex surface includes:

a central convex surface including the top portion;

an inner convex surface connecting the central convex surface and the contact surface disposed below the inner connecting portion; and an outer convex surface connecting the central convex surface and the contact surface disposed below the outer connecting portion, and each of the inner convex surface and the outer convex surface has a shape inclined to approach the imaginary curved surface gradually as being separated from the central convex surface in the foot width direction.

8. The sole according to claim 1, wherein the recessed portion is disposed in a central portion in a foot width direction of the sole, the intervening portion further includes:

an inner connecting portion disposed inside the recessed portion in the foot width direction and connecting the toe support portion and the midfoot support portion; and an outer connecting portion disposed outside the recessed portion in the foot width direction and connecting the toe support portion and the midfoot support portion, and the sole includes a contact surface that overlaps each of the inner connecting portion and the outer connecting portion in the thickness direction, and matches the imaginary curved surface.

9. The sole according to claim 1, wherein the recessed portion has a shape extending from an inner end portion to an outer end portion in a foot width direction of the sole.

10. The sole according to claim 1, wherein the recessed portion includes a pair of concave portions disposed at positions separated from each other in a foot width direction of the sole, each of the pair of concave portions has a shape extending long in the foot length direction, the intervening portion includes:

a central connecting portion disposed between the pair of concave portions and connecting the toe support portion and the midfoot support portion;

an inner connecting portion disposed inside the pair of concave portions in the foot width direction and connecting the toe support portion and the midfoot support portion; and an outer connecting portion disposed outside the pair of concave portions in the foot width direction and connecting the toe support portion and the midfoot support portion, and the sole includes a contact surface that overlaps each of the central connecting portion, the inner connecting portion, and the outer connecting portion in the thickness direction, and matches the imaginary curved surface.

11. The sole according to claim 1, further comprising a plate arranged inside the midsole and having a flexural rigidity greater than a flexural rigidity of the midsole, wherein the plate is arranged on the recessed portion and has a shape crossing over the recessed portion in the foot length direction.

12. A shoe comprising:

the sole according to claim 1; and an upper connected to the sole and providing, together with the sole, an accommodation space for the wearer's foot.

13. The sole according to claim 3, wherein the top portion defining the recessed portion includes a ridge extending in a foot width direction of the shoe or in the foot length direction of the shoe.

14. The sole according to claim 1, the recessed portion including a central region that is flat in a cross section taken in a foot width direction.

15. The sole according to claim 14, the central region extending on either side of a midpoint of the sole in the foot width direction.

16. The sole according to claim 1, the recessed portion including a top portion, wherein when viewed in a cross section in a foot width direction, the top portion includes a first ridge on a first side of the top portion and a second ridge on a second side of the top portion, the second ridge spaced apart from the first ridge, and a flat region extending from the first ridge to the second ridge.

17. The sole according to claim 11, wherein the midsole includes an upper midsole and a lower midsole, and wherein the plate is sandwiched between the upper midsole and the lower midsole in a region directly above the recessed portion.

* * * * *